US007032980B2

(12) United States Patent
Herbert et al.

(10) Patent No.: US 7,032,980 B2
(45) Date of Patent: Apr. 25, 2006

(54) NON-SLIP WHEEL FOR A CHILD'S TOY

(75) Inventors: David J. Herbert, Stow, OH (US); Thomas M. Walraven, Cuyahoga Falls, OH (US)

(73) Assignee: The Little Tikes Company, Hudson, OH (US)

( * ) Notice: Subject to any disclaimer, the term of this patent is extended or adjusted under 35 U.S.C. 154(b) by 279 days.

(21) Appl. No.: 10/421,308

(22) Filed: Apr. 23, 2003

(65) Prior Publication Data

US 2004/0002283 A1 Jan. 1, 2004

Related U.S. Application Data

(60) Provisional application No. 60/392,189, filed on Jun. 27, 2002.

(51) Int. Cl.
*B60B 3/08* (2006.01)

(52) U.S. Cl. ..... 301/64.707; 301/5.308; 301/64.303

(58) Field of Classification Search ..... 301/5.301, 301/5.306, 5.308, 64.301, 64.302, 64.303, 301/64.305, 64.701, 64.706, 64.707; 152/323; 446/465

See application file for complete search history.

(56) References Cited

U.S. PATENT DOCUMENTS

| | | | | | |
|---|---|---|---|---|---|
| 1,480,359 | A | * | 1/1924 | Wood | 301/64.303 |
| 3,048,447 | A | * | 8/1962 | Klint | 301/64.707 |
| 3,066,716 | A | * | 12/1962 | Fishman | 152/323 |
| 3,642,048 | A | | 2/1972 | Poweleit | |
| 3,730,594 | A | | 5/1973 | Zbikowski | |
| 3,985,392 | A | | 10/1976 | Bergmann et al. | |
| RE30,030 | E | * | 6/1979 | Coran et al. | 152/323 |
| 4,170,384 | A | | 10/1979 | Rotheiser | |
| 4,299,051 | A | | 11/1981 | Pauly et al. | |
| 4,558,727 | A | * | 12/1985 | Golata et al. | 152/5 |
| 5,107,913 | A | * | 4/1992 | Clonch et al. | 152/323 |
| 5,186,676 | A | | 2/1993 | Morton | |
| 5,368,371 | A | | 11/1994 | Markling | |
| 5,518,682 | A | | 5/1996 | Markling et al. | |
| 5,765,871 | A | | 6/1998 | Wyman et al. | |
| 6,095,543 | A | | 8/2000 | McMahon et al. | |

* cited by examiner

*Primary Examiner*—Russell D. Stormer
(74) *Attorney, Agent, or Firm*—Renner, Otto, Boisselle & Sklar, LLP

(57) ABSTRACT

A wheel for a child's toy formed from a first and second section. The first section is made from a material having a Shore A durometer of 100 or less. The second section is disposed within the first section. The second section is made from a rigid material and provides structural support for the wheel.

14 Claims, 4 Drawing Sheets

NON-SLIP WHEEL FOR A CHILD'S TOY

CROSS REFERENCE TO RELATED APPLICATION

This application is based on Provisional Patent Application No. 60/392,189 filed on Jun. 27, 2002.

TECHNICAL FIELD OF THE INVENTION

The present invention relates in general to a wheel, and more particularly to a non-slip wheel for a children's toy.

BACKGROUND OF THE INVENTION

Typically the wheels on children's toys, such as a walker or a ride-on, are made from a rigid material, such as high density polyethylene. The rigid wheels do not stabilize the toy. The wheels tend to slide in unexpected directions or cause the toy to move faster than anticipated by the child when in contact with a hard shiny surface, such as a wood, tile or linoleum. Often, the child is unable to control the toy due to the loss of traction between the wheel and the hard shiny surface it encounters.

As a result, there is a desire to construct a wheel for a child's toy that reduces the slippage that occurs between the wheel and the contact surface thereby stabilizing the toy.

SUMMARY OF THE INVENTION

The invention is directed to a wheel that is formed from two sections. The first section of the wheel is made from a pliable material having a Shore A durometer of 100 or less. The second section is made from a rigid material. The second section is disposed within the first section to form the wheel.

BRIEF DESCRIPTION OF THE DRAWINGS

Further aspects of the invention and their advantages may be discerned from the following description when taken in conjunction with the drawings, in which like characters number like parts and in which.

DETAILED DESCRIPTION

Figure 1:
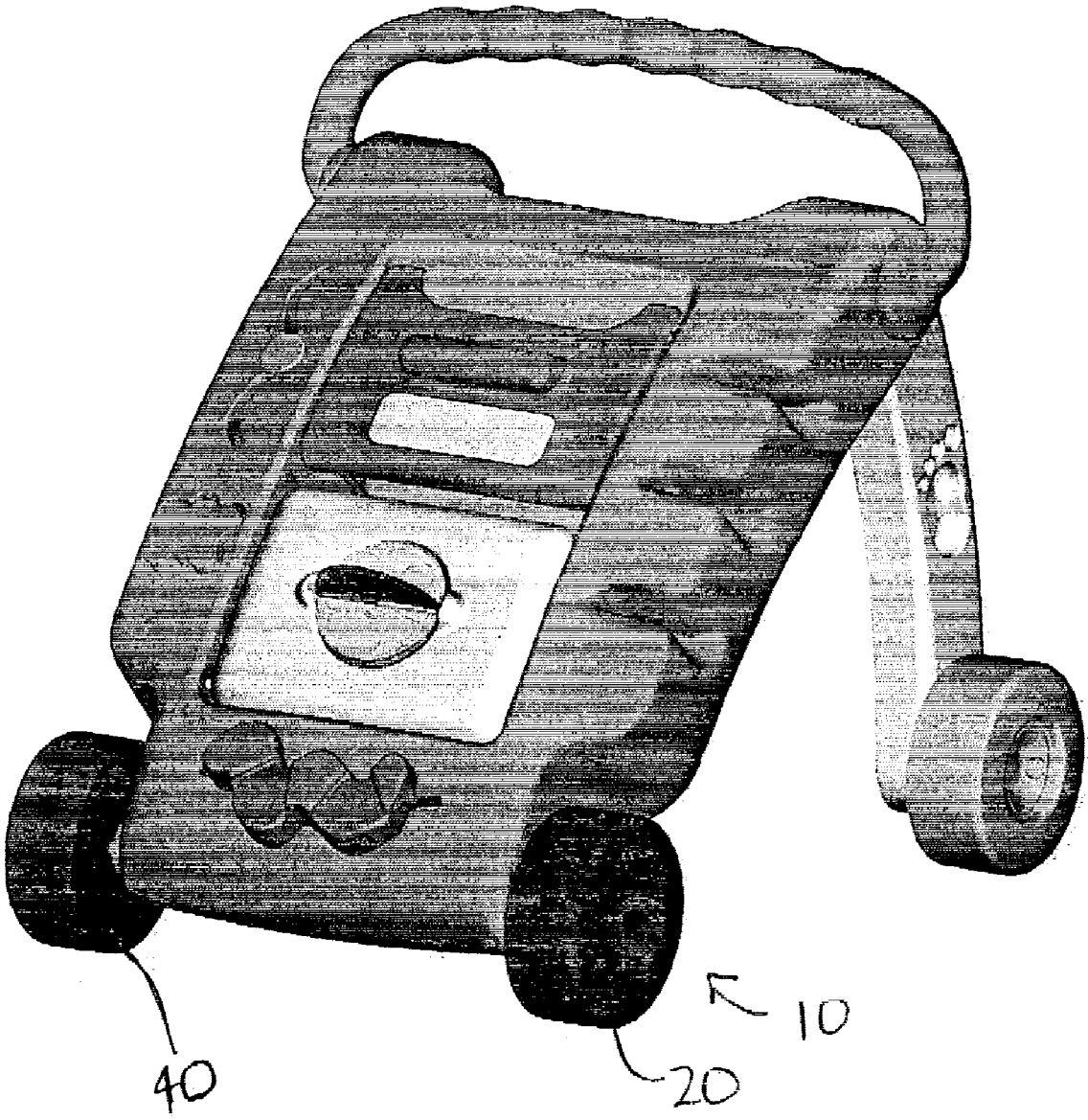
FIG. 1 is a perspective view of the wheel of the present invention assembled on a walker.

As illustrated in FIG. 1, the wheel of the present invention, indicated in general at 10, is installed on a children's walker. Although the wheel is illustrated on a walker, the wheel of the present invention may be used with a variety of children's toys, including ride-ons or toy trucks. The wheel is formed from two injection molded sections, an outer section 20 and an inner section 40.

Figure 2:
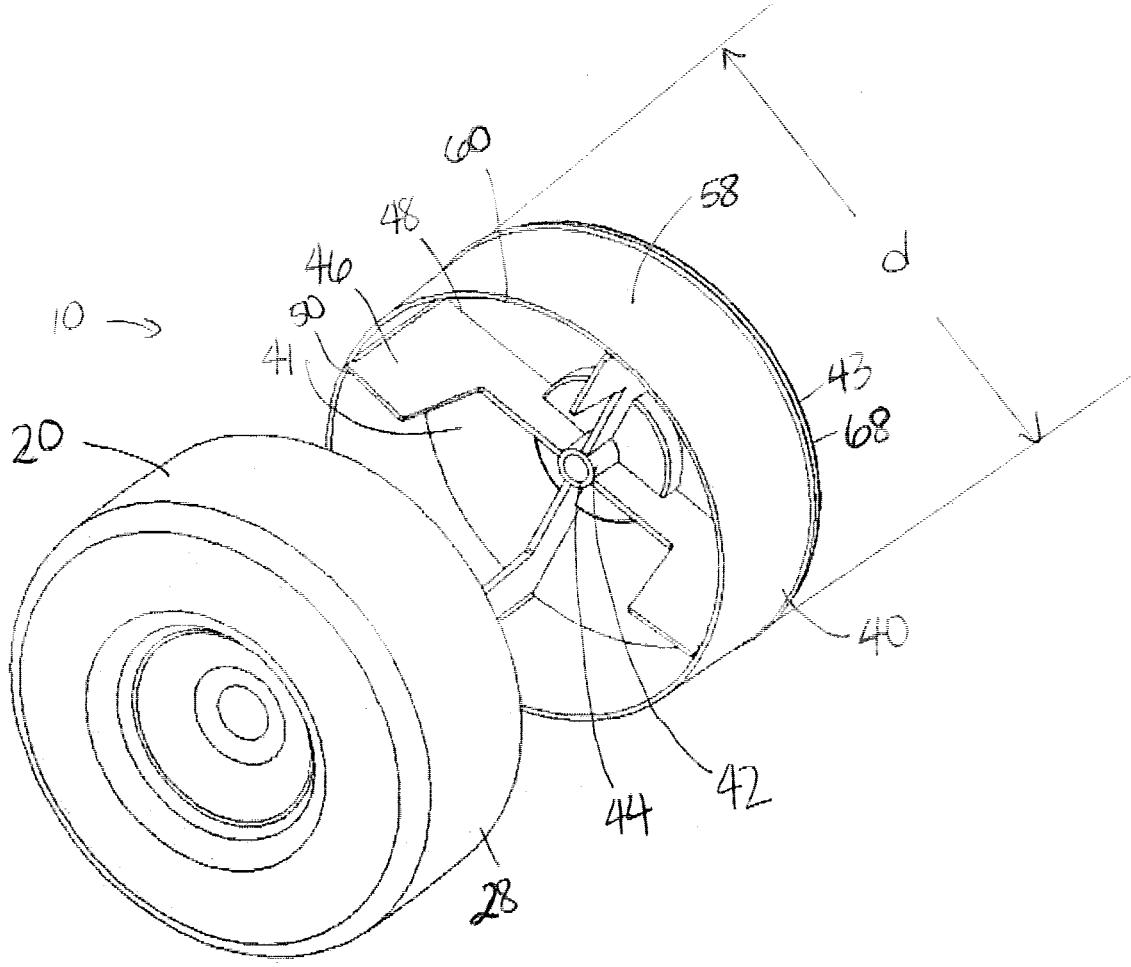
FIG. 2 is an exploded front perspective view illustrating the two sections that form the wheel illustrated in FIG. 1.
Figure 3:
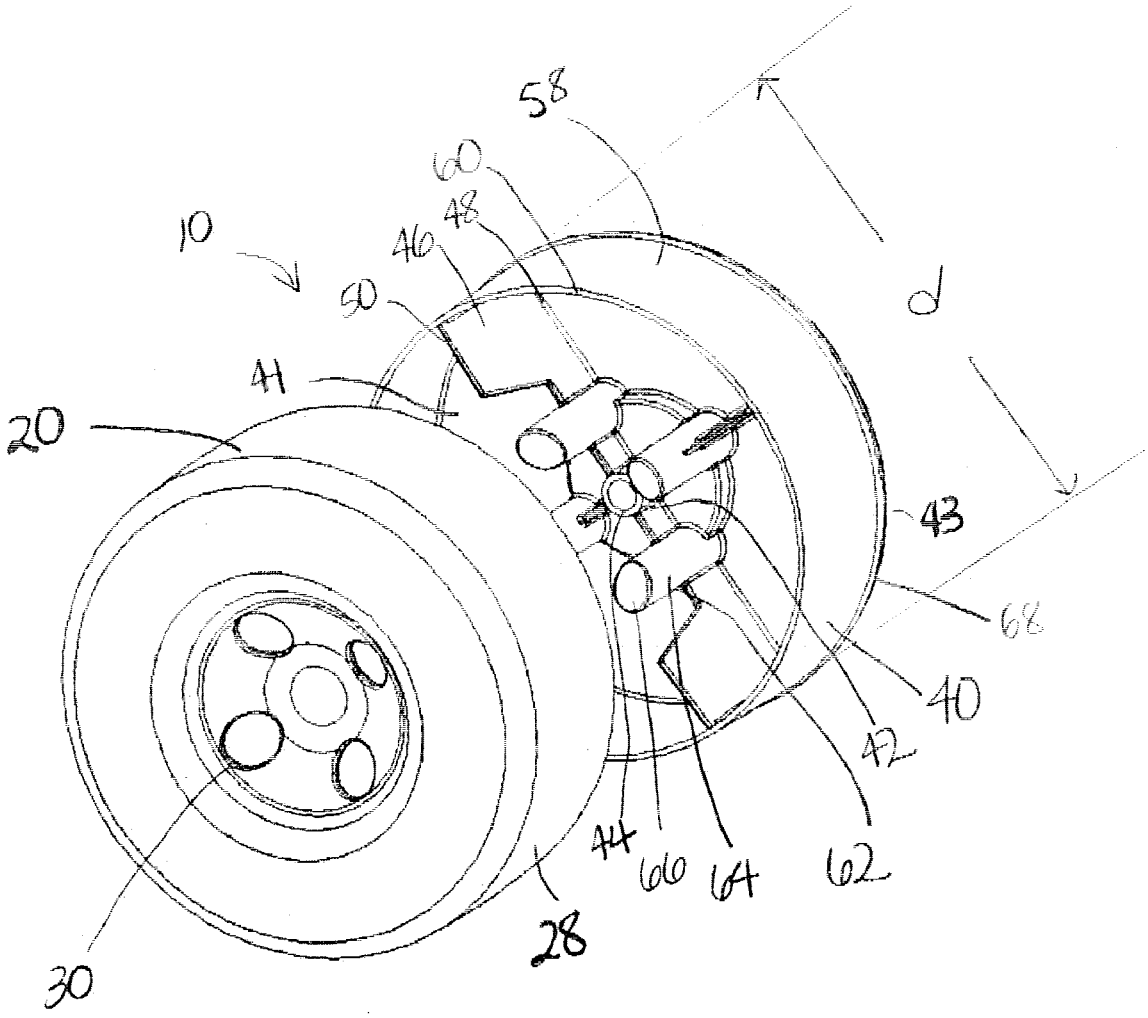
FIG. 3 is an exploded front perspective view of another embodiment of the wheel illustrated in FIG. 1 with the inner section including a number of lugs.
Figure 4:
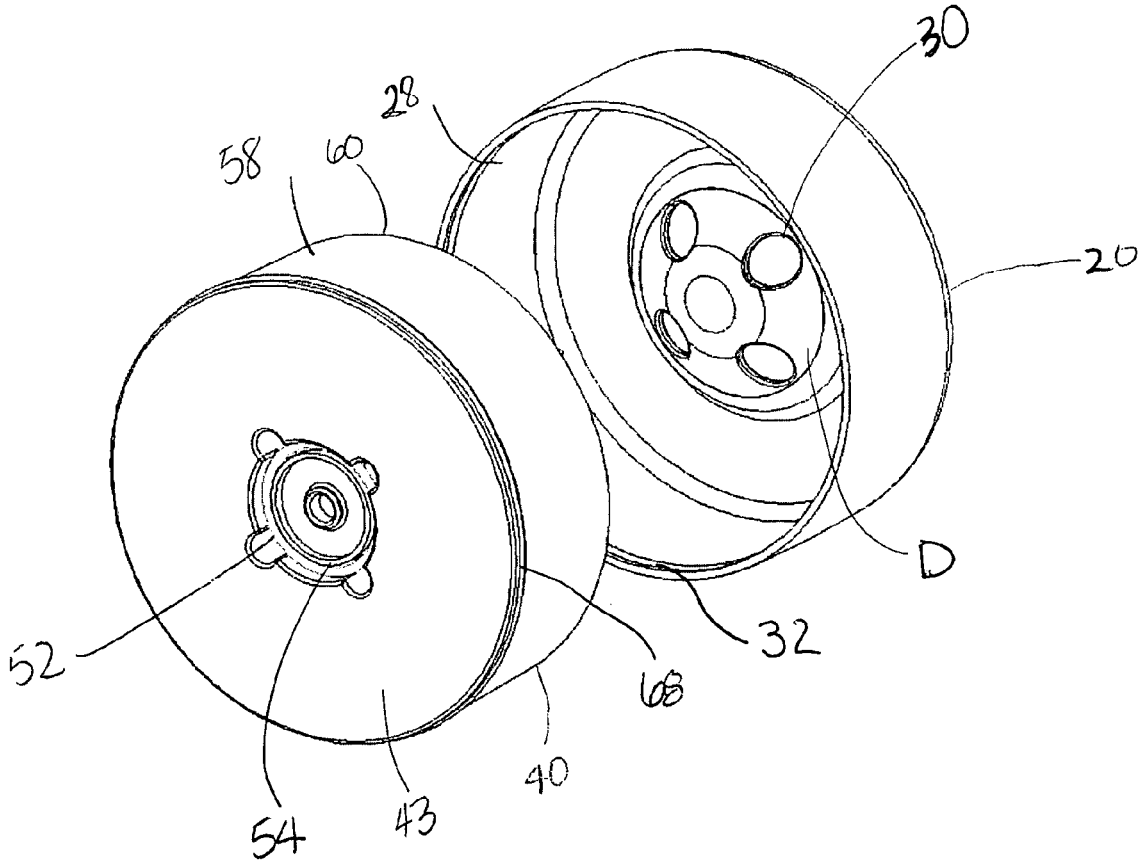
FIG. 4 is an exploded rear perspective view of the wheel illustrated in FIG. 3.

The outer section 20 and the inner section 40 are illustrated in greater detail in FIGS. 2–4. FIG. 2 illustrates the inner surface 41 of the inner section 40 of the wheel. The inner section 40 provides the structural support for the wheel. The rigid inner section 40 is injection molded as a single piece from a plastic material, such as polypropylene or high density polyethylene.

The inner surface of the inner section 40 includes a hub 42 defined by an opening 44. The opening 44 is sized to receive and house an axle (not illustrated) of which the wheel rotates. An alternative to the opening 44 would be to mold the axle to the inner section 40.

A plurality of ribs 46 extend from the hub 42 to an annular support surface 58. A first edge 48 of each rib extends along the radius of the inner side 41 of the inner section 40 until the rib 46 reaches the annular support surface 58. Each rib 46 extends upwardly along the annular support surface 58 towards the outer edge 60 of the annular support surface 58. A second edge 50 of each rib 46 extends outwardly from the hub 42 and then extends upwardly towards the plane where the outer edge 60 of the annular support surface 58 is located. As illustrated in FIGS. 2 and 3, the ribs 46 support the annular support surface 58 of the inner section 40 of the wheel.

In addition, as illustrated in FIG. 3, the inner section 40 may also include a plurality of lugs 62 that extend outwardly from the inner side 41 of the inner section 40 towards the outer section 20. Each lug 62 is a cylindrical projection 64 having a closed end surface 66 that is angled towards the center hub 42 of the inner section 40. When the lugs 62 are present, they would also help provide support for the outer section of the wheel.

The inner section also includes an outwardly extending flange 68. The flange 68 extends around the circumference of the wheel near the outer surface of the wheel. As discussed below, the flange 68 engages the outer section 20 of the wheel thereby securing the inner section of the wheel to the outer section of the wheel.

The outer surface 43 of the inner section 40 of the wheel is illustrated in FIG. 4. The outer surface is designed to abut or contact the outer surface of a toy (see FIG. 1). As a result, the outer surface is preferably a flat or smooth surface. Additionally, as illustrated in FIG. 4, the central portion of the outer surface may be configured with a recess 52 to receive a mounting element or a rotational element, such as a cam. If desired, the recess may house an elastomer gasket 54. The elastomer gasket 54 would prevent the wheel and the toy from rubbing against each other when the wheel rotates about the axle.

The outer section 20 forms a cover that is designed to house the inner section 40. The outer section 20 includes an annular contact surface 28 which is supported by the annular support surface 58 of the inner section 40. The center of the outer section 20 also has a concave shape.

The outer section 20 may also include a plurality of openings 30, preferably when the lugs extend from the inner section, that are situated around the center of the outer section 20. If the inner section 40 of the wheel includes lugs 62, the lugs 62 would be aligned with the openings 30 in the outer section 20 when the wheel is assembled. Depending on the size of the lugs, the lugs may extend through the openings 30 in the outer section 20. Typically, for aesthetic purposes, the lugs would be provided in a color that contrasts to the color of the outer section of the wheel.

The outer section also includes a groove 32 that extends around the circumference of the outer section of the wheel. The groove 32 is formed within the inner surface of the annular contact surface 28. The groove 32 is configured to receive the circumferential outwardly extending flange 68 of the inner section 40.

The outer section 20 is formed as a single piece of pliable material. The pliable material used to form the outer section preferably has a Shore A durometer between approximately 50 to approximately 100. The durometer test or shore hardness test is one of the standard tests for measuring the hardness of a rubber, plastic and other non-metallic material. The recognized specification for the durometer and test procedures are described in the American Society for Testing and Material Specification ASTM D2240. Shore hardness using the Shore A scale is the preferred method for measuring rubbers or elastomers. The durometer test includes a spring loaded indentor which applies a load to the product. The "hardness" or the resistance of the plastic toward the indentation of the product is measured. The "hardness" value is determined by the penetration of the durometer indentor into the product. The durometer also provides an indirect measurement for other material properties of the product, such as elasticity. A high durometer measurement signifies a hard or less resilient material.

Thus, it is desirable to use a material with a Shore A durometer between approximately 50 to approximately 100 for the outer section of the wheel of the present invention. This provides a wheel with sufficient pliability and resistance to deflection and sufficient compressive stiffness to stabilize the wheel when it contacts the ground. Furthermore, the outer section of the wheel would increase the friction between the wheel and the contact surface thereby decreasing the lateral or side-to-side motion of the toy.

There are many pliable materials that fall within the acceptable Shore A durometer range that may be used to form the outer section of the wheel. For example, the outer section of the wheel may be made from a SANTOPRENE elastomer. For example, SANTOPRENE Rubber 121-50M100, which has a Shore A durometer of 50, could be used to form the outer section of the wheel. Alternatively, DuPont Elvax 750 having a Shore A durometer of 95 could be used to form the outer section of the wheel.

Another alternative material that the outer section may be formed from is an ethylene vinyl acetate copolymer with approximately 9% to 18% EVA present. One example of an ethylene vinyl acetate copolymer having a vinyl acetate content of 18% and a Shore A hardness of 85 is ULTRATHENE EVA Copolymer. The ULTRATHENE ethylene vinyl acetate copolymer is available from Equistar Chemicals, LP.

Yet another alternative material that the outer section of the wheel could be constructed from would be Exxon Escorene LD-706 which has a Shore A durometer of 80. The material that forms the outer section is not limited to the above referenced materials. The above materials are referenced only to illustrate a variety of materials having an acceptable Shore A durometer that could be used to construct the outer section of the wheel.

As illustrated in FIGS. 2–4, the inside diameter D of the outer section 20 is slightly larger than the outside diameter d of the inner section 40. The ratio of the outside diameter of the inner section 40 to the inside diameter of the outer section 20

$$\left(\frac{d}{D}\right)$$

is greater than 0.90. This enables the inner section 40 to be press fit into the outer section 20 until the flange 68 of the inner section 40 engages the groove 32 of the outer section 20. Thus, the outer section 20 is retained around the inner section 40 due to the frictional fit between the sections and the circumferential flange of the inner section engaging the circumferential groove of the outer section.

Alternatively, the inner section of the wheel may be designed without the outwardly extending flange and the outer section of the wheel may be designed without the groove. Instead, the outside diameter of the inner section may be increased or the inside diameter of the outer section may be decreased so that the inner section may be retained in the outer section merely by the frictional fit between the sections. The inner section may also be retained or secured to the outer section by an adhesive.

The inner and outer sections of the wheel are both injection molded. It is possible to blow-mold or roto-mold the sections of the wheel. However, production of the wheel sections by blow-molding or roto-molding would not be as cost effective.

Thus, the wheel of the present invention is designed to prevent the loss of traction between the wheel and the ground contact surface. The pliable material of the wheel increases the friction force between the wheel and the contact surface. As a result, the wheels of the toy do not slip out from underneath the child or slide sideways so that the child can not control the toy. The wheels stabilize the toy since the wheels decrease lateral motion when the toy is pushed or pulled. Also, the pliable material provides a wheel that is less likely to scratch the ground contact surface and is quiet as it contacts the ground contact surface.

The wheel may be used with a variety of applications including, but not limited to, children's toys such as a walker, ride-ons or toy trucks.

Therefore, while the invention has been described with respect to the illustrated embodiment, it is not limited thereto, but only by the scope and spirit of the appended claims.

We claim:

1. A wheel for a child's toy, the wheel comprising:

a first section, the first section being made from a material having a Shore A durometer of 100 or less; and a second section disposed within the first section, the second section being made from a rigid material, wherein the second section provides structural support for the first section;

the first section having a front wall and a cylindrical wall extending rearwardly from a radially outer periphery of the front wall;

the second section having a rear wall and a cylindrical wall (58) extending forwardly from a radially outer periphery of the rear wall; and the cylindrical wall of the second section being telescopically axially inserted into the cylindrical wall of the first section to support the cylindrical wall of the first section over the axial extent thereof.

2. The wheel of claim 1, wherein the first section is made from a low density polyethylene.

3. The wheel of claim 1, wherein the first section is made from a SANTOPRENE elastomer.

4. The wheel of claim 1, wherein the first section is made from ULTRATHENE ethylene vinyl acetate copolymer.

5. The wheel of claim 1, wherein the first section is made from Exxon Escorene LD1 206.

6. The wheel of claim 1, wherein the first section is made from Dupont Elvax 750.

7. The wheel of claim 1, wherein the first section has an inside first diameter and the second section has an outside second diameter, wherein the ratio of the second diameter to the first diameter is greater than 0.90.

8. The wheel of claim 1, wherein the first section includes an annular contact surface and the second section includes an annular support surface, wherein the annular support surface carries and supports the annular contact surface.

9. The wheel of claim 8, wherein the first section has a groove formed in an inside surface of the annular contact surface and the second section has a flange extending from an outer surface of the annular support surface, the flange is disposed in the groove when the second section is positioned in the first section.

10. The wheel of claim 1, wherein the second section is retained within the first section by friction.

11. The wheel of claim 1, wherein the second section is retained in the first section by an adhesive.

12. The wheel of claim 1, wherein the second section includes a hub with an opening for receiving an axle and a plurality of ribs extending from the hub for providing support to the wheel.

13. The wheel of claim 1, wherein the first section includes a plurality of openings around a center of the first section and the second section includes a plurality of lugs extending from the second section and being aligned with the openings when the second section is positioned within the first section.

14. The wheel of claim 13, wherein the lugs are cylindrical with a closed end that is angled towards a center of the second section.

* * * * *